United States Patent [19]

Bianchino

[11] 4,235,252

[45] Nov. 25, 1980

[54] SMOKING PIPE

[76] Inventor: Daniel C. Bianchino, Box 10,, Intervale, N.H. 03845

[21] Appl. No.: 18,287

[22] Filed: Mar. 6, 1979

[51] Int. Cl.[3] ..... A24F 1/24

[52] U.S. Cl. ..... 131/193; 131/176; 131/224

[58] Field of Search ..... 131/193, 191, 176, 177, 131/224

[56] References Cited

U.S. PATENT DOCUMENTS

| | | | |
|---|---|---|---|
| 408,341 | 8/1889 | Emery et al. | 131/193 |
| 768,685 | 8/1904 | Pearce | 131/176 |
| 1,071,356 | 8/1913 | Seidenberg | 131/193 |
| 1,258,454 | 3/1918 | Pinkney | 131/193 |
| 3,106,922 | 10/1963 | Hefti | 131/176 |

*Primary Examiner*—Stephen C. Pellegrino
*Attorney, Agent, or Firm*—Peter Xiarhos

[57] ABSTRACT

A smoking pipe having improved smoking characteristics. The smoking pipe includes a bowl having top and bottom openings and a breather hole near the top opening and in communication with a pipe stem. A cover assembly is attached to the bowl adjacent to the top opening and covers the top opening when the pipe is to be smoked. A retainer having a screen cooperates with the bottom opening for retaining smoking tobacco within the bowl while permitting access to the tobacco for the ignition thereof. The retainer may also be removed from its position relative to the bottom opening for the removal of ashes.

Tobacco is inserted into the bowl via either opening, but preferably via the top opening and to a level just below the breather hole. With the cover assembly covering the top opening, the tobacco is ignited via the screen of the retainer, causing combustion of the tobacco in a bottom-to-top fashion. New tobacco may be added to existing tobacco via the top opening and ashes may be removed via the bottom opening, even as the smoking process takes place. The bottom-to-top combustion minimizes puddling of tobacco juices or the requirement of drying out periods and facilitates lighting the pipe in the presence of wind, rain, etc. The lack of obstruction of the breather hole by the presence of tobacco results in a smooth draw with the generation of a substantial, satisfying volume of smoke.

8 Claims, 9 Drawing Figures

SMOKING PIPE

BACKGROUND OF THE INVENTION

The present invention relates to a smoking pipe and, more particularly, to a smoking pipe having improved smoking characteristics.

Most smoking pipes in common use today generally include a bowl into which pipe tobacco is placed and a stem in communication with a breather hole located at or near the bottom of the bowl. As the tobacco is ignited and the user draws on the stem to establish and to support combustion of the tobacco, the combustion takes place in a top-to-bottom fashion with the smoke produced by the combustion process being drawn through the breather hole and the stem and discharged to the outside environs. The production of ashes also takes place in a top-to-bottom fashion during normal use of the pipe.

While pipes of the above general type have been in widespread use for many years and found generally acceptable to the pipe smoking public, there are certain shortcomings and disadvantages to these pipes. For instance, the user of such a pipe must be sure to establish and maintain a sufficient draw to support continous combustion of the tobacco and to achieve a satisfactory volume of smoke, that is, to overcome the fact that the breather hole is physically obstructed by the presence of tobacco. Thus, the user must be continuously attentive to the smoking process to prevent the pipe from extinguishing, often a disconcerting annoyance. Further, if during smoking of the pipe or upon completion of smoking one pipe full of tobacco the user wishes to add more tobacco to the pipe, he must engage in the time-consuming process of extinguishing the pipe by removing all of the existing ashes (being careful not to get burned in the process), reloading the pipe with new tobacco, and re-igniting the pipe. Repetition of the abovedescribed pipe-smoking process over an extended period of time can have the further undesirable effect of causing tobacco juices to accummulate, or "puddle," at the bottom of the bowl adjacent to the breather hole with the result that filters must be used to remove these juices if they are drawn into the stem or the pipe must otherwise be permitted to "dry out" before reusing. The continued use of a pipe in which juices accummulate can, in any event, lead to a harsh, bitter or otherwise unpleasant taste experience on the part of the user. This latter reason is a common reason why most serious pipe smokers ordinarily have several pipes among which they can choose to achieve satisfactory smoking experiences.

An additional disadvantage of pipes as described above is that such pipes must be ignited from the top, thereby requiring the user to "fight" the natural tendency of the flame from matches or lighters to be directed upwardly (except in cases of special pipe lighters) rather than toward the tobacco. This latter problem is most annoying or frustrating in attempts to light pipes out-of-doors in the presence of winds or rain. A further disadvantage of pipes as described above is that the user must be very careful in the physical handling of the pipe, for example, by the expeditious use of ashtrays and the like, to prevent ashes from falling out of the pipe and causing damage or messing nearby areas. This problem is most common in the case of pipes having bowls of rounded or other physically unstable shapes which require the user to be especially careful in the handling and placement of the pipes.

BRIEF SUMMARY OF THE INVENTION

In accordance with the present invention a smoking pipe is provided which avoids the shortcomings and disadvantages of smoking pipes such as described hereinabove. The smoking pipe in accordance with the invention includes a bowl of unique design in that it has a bore defining both a top opening and an opposed bottom opening and it further has a breather hole adjacent to the top opening. This bowl, which is adapted to receive an ignitable smoking product therein, such as smoking tobacco, is employed in the pipe in accordance with the invention together with a cover means cooperating with the top opening of the bowl and a retainer means cooperating with the bottom opening of the bowl. The cover means is operable between first and second positions in which the cover means respectively covers and uncovers the top opening and is employed in its first position when a smoking product in the bowl is to be ignited. The retainer means is operable to retain a smoking product within the bowl while permitting access to the smoking product in the bowl for igniting the smoking product. The pipe further includes means cooperating with the breather hole in the bowl for discharging smoke produced in the bowl as a result of ignition of the smoking product in the bowl.

BRIEF DESCRIPTION OF THE DRAWING

Various objects, features and advantages of a smoking pipe in accordance with the present invention can be had from the following discussion taken in conjunction with the accompanying drawing in which.

DETAILED DESCRIPTION OF THE INVENTION

Figure 1:
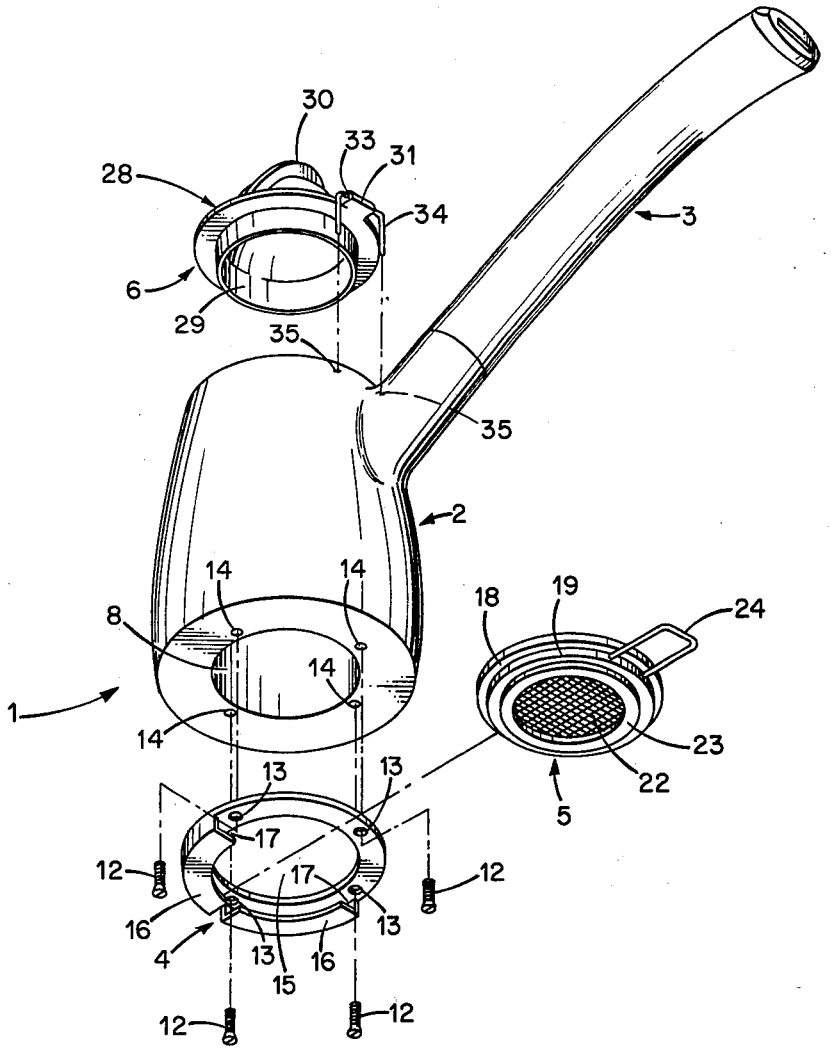
FIG. 1 is an exploded perspective view of a smoking pipe in accordance with the present invention.
Figure 2:
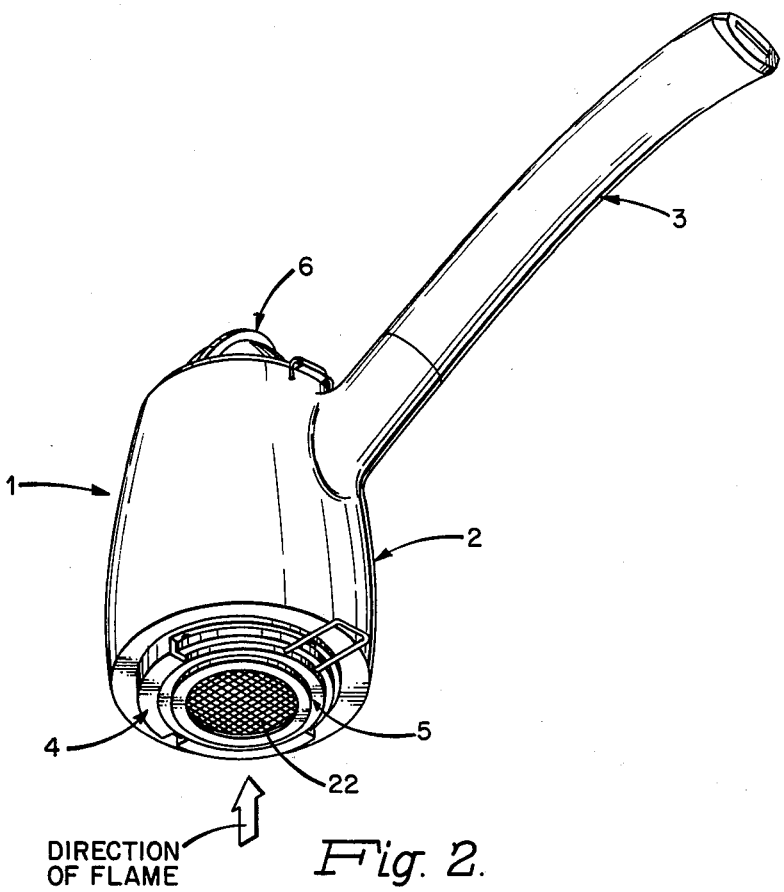
FIG. 2 is a perspective view of the smoking pipe of FIG. 1 in its final, assembled form.

Referring now to FIG. 1, there is shown in an exploded perspective view a smoking pipe 1 in accordance with the present invention. As shown in FIG. 1, the pipe 1 generally includes a bowl 2, a stem 3, a bracket or holder 4, a retainer 5 and a cap assembly 6. When the abovementioned elements are assembled together to produce the completed pipe 1, the pipe 1 has the general form as shown in FIG. 2.

Figure 3:
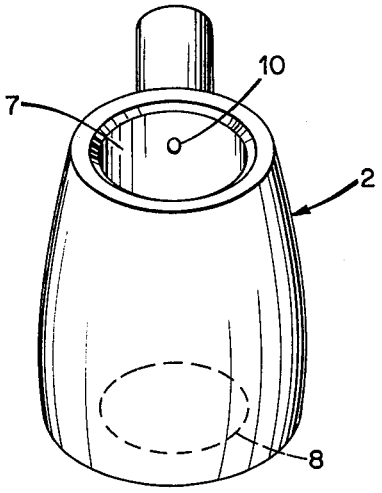
FIG. 3 is a perspective view of a bowl employed in the smoking pipe of the invention.

The bowl 2 of the pipe 1, which may be of briar, plastic or other suitable material, is similar to a conventional pipe bowl but differs in two significant respects. Firstly, and as best shown in FIG. 3, the bowl 2 has a bore defining both a top opening 7 and an opposed bottom opening 8 instead of a single top opening as in a conventional pipe bowl and, secondly, and as also shown in FIG. 3, the bowl 2 has a breather hole 10 located near the top opening 7 rather than at or near the bottom. Although the significance of the above differences will become more fully apparent hereinafter, it may nonetheless be mentioned here that the bowl 2 may be loaded with tobacco by way of either of its two openings 7 and 8 but that ignition of the tobacco is initiated only by way of its bottom opening 8. This latter operation is clearly impossible with conventional pipes. Further, and consistent with the above, the combustion of tobacco loaded into the bowl 2 takes place in a direction from the bottom opening 8 toward the top opening 7 rather than from top to bottom as in the case of conventional pipes.

The stem 3 of the pipe, which may be of plastic or other suitable material, is connected in a conventional fashion with the bowl 2 so that the stem 3 communicates with the breather hole 10 to permit discharge of smoke to the outside environs during normal use of the pipe 1. If desired, the stem 3 may be used with a pipe filter (not shown) for the filtration of particulants or other undesirable matter present in the smoke.

Figure 4:
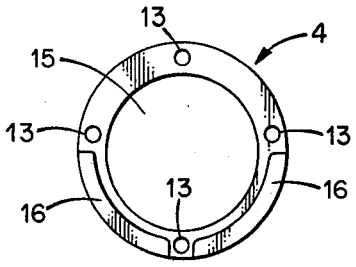
FIG. 4 is a bottom view of a holder employed in the smoking pipe of the invention.
Figure 5:
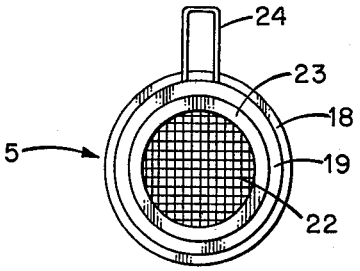
FIGS. 5 and 6 are bottom and top views, respectively, of a retainer employed in the smoking pipe of the invention.
Figure 6:
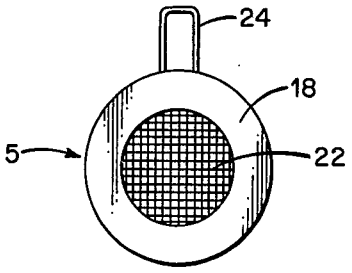
Figure 7:
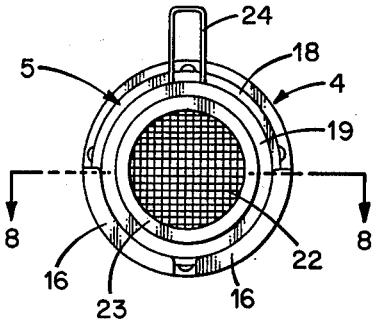
FIG. 7 is a view illustrating the manner of cooperation of the holder and retainer shown in FIGS. 4–6.
Figure 8:
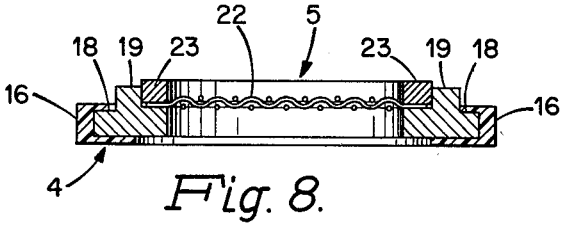
FIG. 8 is a cross-sectional view of the assembly of FIG. 7, taken along a line 8—8 in FIG. 7 and shown in enlarged form.

The abovementioned bracket or holder 4, which may be of aluminum or other suitable material, is attached to the bottom end of the bowl 2, for example, by means of small wood screws 12, FIG. 1, inserted through corresponding openings 13 in the holder 3 and threaded into openings 14 in the bowl 2. Any other convenient means of attachment may also be used. The holder 4 is adapted to receive and cooperate with the retainer 5, as will be discussed below, so as to confine tobacco and ashes within the bowl 2 while still permitting access to the bottom opening 8 of the bowl 2 for igniting tobacco within the bowl 2 and for removing ashes. As shown in FIGS. 1 and 4, the holder has a central opening 15 of the same size as, and coaxial with, the bottom opening 8 of the bowl 2 and a pair of curved ridge portions 16 at one side defining corresponding slots 17 (FIG. 1) for the receipt of the retainer 5. As shown in FIGS. 5–8, the retainer 5 has a first annular portion 18 adapted to be positioned within the slots 17 of the ridge portions 16 of the holder 4 and a second, raised annular portion 19 adapted to abut against the inside, exposed edges of the ridge portions 16. The retainer 5 further includes a round screen or mesh element 22 which is force fit against the annular portion 18 by means of a ring portion 23. The retainer 5 may be alternately inserted into and withdrawn from the slots 17 of the holder 4 by means of a small U-shaped finger holder 24 attached in any suitable manner, for example, by insertion into small openings provided in the raised portion 19 of the retainer 5. Any other suitable means of construction of the retainer 5 by which the screen or mesh element 22 may be made to removably cooperate with the holder 4 and be disposed adjacent to and coaxial with the bottom opening 8 of the bowl 2 may also be used. It may also be possible to provide a retainer which can be removably force fit within the bowl 2 adjacent to the bottom opening 8. The retainer 5 as described above may be constructed of stainless steel, brass, or any other suitable non-toxic metal.

Figure 9:
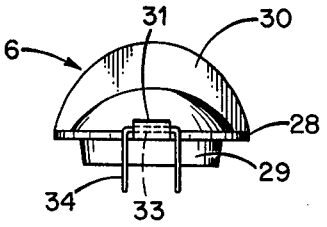
FIG. 9 is a view of a cap assmebly employed in the smoking pipe of the invention.

To complete the assembly of the pipe 1 as discussed above, the aforementioned cap assembly 6 is attached to the top end of the bowl 2 so as to completely seal off the top opening 7 and thereby enclose the top end of the bowl 2. The cap assembly 6 as employed in accordance with the invention includes, as shown in FIGS. 1 and 9, a cap 28 having an inner ring portion 29 and a finger-grip portion 30, a pivot portion 31 at an edge of the cap 28 and having an opening 33 therethrough, and a generally U-shaped clip 34 retained within the opening 33 in the pivot portion 31. The cap assembly 6 is attached to the bowl 2 by inserting the ends of the clip 34 in corresponding openings 35 (FIG. 1) provided in the bowl 2, following which the cap 28 is able to pivot about the clip 34. Any other suitable manner of attachment of the cap 28 to the bowl 2 may also be used. By way of example, by proper dimensioning of the inner ring portion 29 of the cap 28 and the bore in the bowl 2, the cap 28 can be force fit into the bowl 2 and be removable by use of the finger grip portion 30. Alternatively, threads could be provided on the ring portion 29 of the cap 28 and threaded into corresponding threads provided in the bowl 2 adjacent to the top opening 7 of the bowl 2. Whatever the technique used for securing the cap assembly 6 to the bowl 2, for most efficient operation of the pipe 3 the cap assembly 6 should provide an air tight fit with the bowl 2.

The cap 28 as described above may also be used to satisfy the esthetic tastes, preferences and interests of the user. By way of example, the exterior portions of the cap 28 or the entire cap 28 itself could be made in a variety of possible shapes, colors, designs and materials and, if several caps 28 are provided, be used in an interchangeable fashion as desired.

To employ the pipe 1 as described above, the user must first fill the bowl 2 with tobacco. Although the tobacco may be loaded into the bowl 2 via either of the openings 7 and 8 which, for simplicity of design are of essentially the same size and shape, the preferred method is to open or remove the cap 28 and, with the retainer 5 inserted within the holder 4 as shown in FIG. 2, to insert the tobacco into the bowl 2 via the top opening 7 and to fill the bowl 2 to a level just below the breather hole 10. The tobacco is retained within the bowl 2 by the retainer 5 being held within the holder 4. With the tobacco at a level below the breather hole 10 it cannot and does not physically obstruct the breather hole 10, a significant difference from conventional pipes.

Once the bowl 2 has been properly loaded with tobacco and the cap 28 placed in its closed position, the tobacco can be ignited by simply placing the flame of a match or lighter beneath the retainer 5, as indicated, for example, in FIG. 2, so that the flame passes through the mesh or screen element 22 and ignites the tobacco. Since the natural tendency of a flame from a match or lighter (other than a special pipe lighter) is to be directed upwardly, the ignition of the tobacco is very greatly facilitated by taking advantage of this fact rather than "fighting" it as in the case of conventional pipes. This use of the natural direction of a flame also makes it easier to light the pipe 1 in the presence of wind, rain, etc.

Once the tobacco in the bowl 2 has been ignited as discussed above, the user draws smoke in the usual manner by drawing on the stem 3. As the smoking of the pipe 1 progresses, the tobacco in the bowl 2 burns in a direction from the bottom of the bowl 2 toward the top of the bowl 2, thereby facilitating the continuation of the tobacco burning process. This mode of burning is contrary to that of conventional pipes in which the tobacco burns from top to bottom. Since the tobacco in the bowl 2 does not obstruct the breather hole 10, the draw of the pipe 1 tends to be easier and smoother than with conventional pipes and a generally greater and satisfying volume of smoke can be generated. Further, as the smoking of the pipe progresses, any juices which are produced tend not to form at the bottom of the pipe 1, as is normally the case with conventional pipes, but rather at the top of the pipe 1, more particularly, near the breather hole 10 and on interior surfaces of the cap 28. These juices, however, may be easily and quickly removed, even as smoking of the pipe 1 takes place, by simply wiping clean the areas or surfaces on which the juices form. Clearly, this latter operation is not possible with conventional pipes.

If during the smoking of the pipe 1 the user desires to add additional tobacco, the addition of this tobacco is easily accomplished, even as the smoking of the pipe 1 takes place, by simply lifting up or removing the cap 28 and placing the new tobacco on top of the existing tobacco. Since the tobacco burns in a bottom to top fashion with the ashes forming at the bottom of the pipe 1 rather than at the top as with conventional pipes, the addition of new tobacco does not cause the pipe 1 to become extinguished or to expose the user to the danger of being burned in any fashion by attempting to remove hot ashes. Of course, as the amount of ashes builds up, especially after several additions of new tobacco, it will become necessary to remove enough ashes to accommodate the addition of new tobacco. This removal of ashes can be easily accomplished, however, without extinguishing the pipe 1, by simply removing the retainer 5 from the holder 4 and removing the appropriate amount of ashes. After a period of practical use and experience with the pipe 1, the user will generally be able to smoke the pipe 1 continously over a prolonged period of time without the pipe 1 becoming extinguished. This mode of operation is clearly not possible with conventional pipes.

If during the use of the pipe 1 a user finds it desirable or necessary for any reason to temporarily discontinue smoking the pipe 1, the pipe 1 can be conveniently placed on its side without the fear of ashes falling out of the bowl 2 and causing damage to or messing nearby areas. In this situation, the retainer 5 serves to safely confine the ashes within the bowl 2. Thus, under ordinary circumstances, no special handling of the pipe 1 or the ashes therein is required. It is further possible in the above situation to keep the pipe 1 going by simply blowing periodically into the retainer 5 thereby maintaining combustion of the tobacco in the bowl 2.

After a user no longer wishes to smoke the pipe 1 and desires to clean the pipe 1, it is only necessary to lift up or remove the cap 28, to remove the retainer 5 from the holder 4, and to push the tobacco and ashes within the bowl 2 straight through the bowl 2 in either direction. This removal of tobacco and ashes can be accomplished by a standard pipe tool or, if caution is taken, simply by use of a finger. With the appropriate removal of tobacco juices as discussed above, the pipe 1 is dry and can be used again at any time and without requiring a "drying out" period.

It will now be apparent that a smoking pipe 1 has been described which offers numerous advantages over conventional smoking pipes. By virtue of the provision of the bowl 2 having two openings 7 and 8 and a breather hole 10 near the top opening 7 it is possible to achieve an ignition and combustion of pipe tobacco in a bottom-to-top fashion while permitting the introduction of new tobacco and the removal of ashes even while the smoking operating is in process. The lack of obstruction of the breather hole 10 by the presence of tobacco results in a smooth and easy draw and the generation of a substantial, satisfying volume of smoke. There is no puddling of tobacco juices and, thus, reduced or minimal harsh or bitter taste effects. The easy removal of tobacco juices further eliminates or minimizes the need for "drying out" periods. The fact that the cap 28 and the retainer 5 are removable allows rapid cleaning of the pipe 1 and, when these elements are in their positions covering the openings 7 and 8, the undesirable falling out of ashes is prevented. The bottom-to-top manner of operation also facilitates lighting the pipe 1 out-of-doors in the presence of wind, rain, etc.

While there has been described what is considered to be a preferred embodiment of the invention it will be apparent to those skilled in the art that various changes and modifications may be made therein without departing from the invention as called for in the appended claims.

What is claimed is:

1. A smoking pipe comprising:

a bowl adapted to receive an ignitable smoking product therein, said bowl having a bore defining a wall of continuous thickness and a top opening and an opposing bottom opening, said wall having a breather hole adjacent to the top opening extending linearly and completely through said wall;

cover means cooperating with the top opening of the bowl and operable between first and second positions in which the cover means respectively covers and uncovers the top opening, said cover means being in its first position when a smoking product in the bowl is to be ignited;

holder means cooperating with the bottom opening of the bowl;

a screen member received and held by the holder means and removably fitted adjacent to the bottom opening of the bowl, said screen member being capable of complete retraction and separation from the holder means and the rest of the pipe, said screen member including cross grid portions exposed at all times directly to the atmosphere and defining a plurality of openings in the screen member, said screen member including the cross grid portions and openings defined therein being operable to retain and support a smoking product within the bowl while simultaneously permitting passage of a flame by way of the openings defined by the cross grid portions to ignite the smoking product directly by way of said openings, said screen member thereafter being operable to support and confine ashes produced by the combustion of the smoking product above the screen member in the region of the bowl above the screen member; and pipe stem means having a passageway therein in direct line with the breather hole in the bowl and directly cooperating with the breather hole in the bowl for discharging smoke produced as a result of ignition and combustion of the smoking product in the bowl.

2. A smoking pipe in accordance with claim 1 wherein:

the holder means includes a receiving portion; and the screen member is movable between a first portion in which the screen member is received and held by the receiving portion of the holder means and covers the bottom opening of the bowl and supports and retains a smoking product within the bowl while simultaneously permitting passage of a flame by way of the openings defined in the screen member for the ignition of the smoking product and thereafter to support thereupon ashes produced by the combustion of the smoking product, and a second position in which the screen member is completely and retractably removed from the receiving portion of the holder means and the bottom opening of the bowl and separated from the rest of the pipe for permitting cleaning of the pipe.

3. A smoking pipe in accordance with claim 2 wherein:

the receiving portion of the holder means is spaced from and adjacent to the bottom opening of the bowl and operative to receive and hold the screen member in its first position covering the bottom opening of the bowl when a smoking product in the bowl is to be ignited.

4. A smoking product in accordance with claim 3 wherein:

the receiving portion of the holder includes a bracket secured to the bowl adjacent to the bottom opening of the bowl for receiving and holding the screen member; and the screen member further has a holder attached thereto for facilitating the insertion and complete retraction of the screen member from the bracket and the rest of the pipe.

5. A smoking pipe in accordance with claim 2 wherein:

the bore of the bowl defines top and bottom openings of essentially the same size and configuration.

6. A smoking pipe in accordance with claim 5 wherein:

the cap means is operable when in its second position and while a smoking product in the bowl is ignited to permit access to the bowl via the top opening for the addition of further smoking product on top of the existing smoking product within the bowl.

7. A smoking pipe in accordance with claim 1 wherein:

the cap means is arranged when in its first position to establish an air-tight fit with the top opening in the bowl and operable when in its second position and while a smoking product in the bowl is ignited to permit access to the bowl via the top opening for the addition of further smoking product on top of the existing smoking product within the bowl.

8. A smoking pipe in accordance with claim 7 wherein the cap means comprises:

a cap having first and second positions in which the cap respectively covers and uncovers the top opening of the bowl; and pivot means securing the cap to the bowl and permitting the cap to pivot between is first and second positions.

* * * * *